United States Patent [19]

Faleck et al.

[11] 4,142,721

[45] Mar. 6, 1979

[54] WEIGHT AND BELT ASSEMBLY

[76] Inventors: George Faleck, 201 E. 21st St., New York, N.Y. 10010; Alvin Solomon, 2 West End Ave, Brooklyn, N.Y. 11235

[21] Appl. No.: 802,465

[22] Filed: Jun. 1, 1977

[51] Int. Cl.[2] ..... A63B 49/04

[52] U.S. Cl. ..... 273/73 R; 273/29 A

[58] Field of Search ..... 273/26 B, 26 C, 29 A, 273/73 R, 73 C, 72 R, 162 R, 169, 171, 189 R, 189 A, 193 R, 194 R, 194 A, 194 B, 54 B; 128/87 R, 165, DIG. 15; 272/96

[56] References Cited

U.S. PATENT DOCUMENTS

| | | | |
|---|---|---|---|
| 3,790,168 | 2/1974 | Hashimoto | 273/54 B |
| 3,850,167 | 11/1974 | Seeley | 128/87 R |
| 3,858,881 | 1/1975 | Hurwitz | 273/29 A |
| 3,877,426 | 4/1975 | Nirschl | 273/189 R X |
| 3,900,199 | 8/1975 | McGonagle | 273/189 A |
| 3,970,305 | 7/1976 | Hawkins | 273/54 B |
| 4,000,893 | 1/1977 | Evans | 273/73 R X |
| 4,005,864 | 2/1977 | Stewart | 273/73 R |
| 4,014,327 | 3/1977 | Spiro | 128/165 |
| 4,061,340 | 12/1977 | Husted | 273/189 R |

FOREIGN PATENT DOCUMENTS

| | | | |
|---|---|---|---|
| 336,025 | 12/1903 | France | 273/54 B |
| 1,000,769 | 5/1963 | United Kingdom | 273/54 B |

OTHER PUBLICATIONS

"World Tennis;" Jun. 1975; p. 79.

*Primary Examiner*—Richard J. Apley
*Attorney, Agent, or Firm*—Michael Ebert

[57] ABSTRACT

A weight and belt assembly which may be strapped on a tennis racquet at any desired position along the shaft thereof in order to modify the balance of the racquet or to serve as a training aid. The assembly consists of a weighted plate having a pair of parallel slots therein and a belt which is threaded through the slots to support the plate. A buckle loop is attached to one end of the belt and a tab to the other, the tab having a uniform pile of stiff hook-shaped fibers thereon which constitute the male component of a fabric fastener whose female component is formed along the surface of the belt by randomly dispersed fibers. To strap the assembly to the shaft at a desired position thereof, the shaft is encircled by the belt with the plate lying against one side thereof, the tab being pulled through the buckle loop on the other side of the shaft and being folded over to cause the male component to engage the female component, thereby holding the assembly tightly on the shaft.

5 Claims, 5 Drawing Figures

15
16
17
18

13
12

15
10
F
16
11
14
17
11
18

15
15A
15B 17
16
F
M
18

WEIGHT AND BELT ASSEMBLY

BACKGROUND OF INVENTION

This invention relates generally to weights attached to a playing racquet, and more particularly to a weight and belt assembly which may be strapped on a tennis racquet at any desired position along the shaft thereof to modify the balance of the racquet or to serve as a training aid.

A racquet is a light bat constructed by a netting of catgut, nylon or other fiber stretched across a somewhat oval open frame to which a handle shaft is attached, the shaft terminating in a grip. Racquets are used to strike a ball in tennis, badminton and similar games, the geometry of the racquet depending on the game for which it is intended. While the invention will be described in connection with a tennis racquet, it is to be understood that the weight and the belt assembly is applicable to other forms of racquets, and that with appropriate changes, it lends itself to use in conjunction with baseball bats or golf clubs.

While international standards have been established for tennis balls, the design of tennis racquets is not subject to standardization and is in the hands of various manufacturers. There appears to be no general agreement as to those physical characteristics of a racquet which give rise to superior play. The better quality racquets presently on the market differ in significant respects, not only with regard to the materials used (plastic, wood, metal), but also in their weight distribution. Thus some racquets are head-heavy while others are handle-heavy, and still others are more or less balanced as between head and handle.

The reason for these variations in balance is to satisfy the requirements of different players, for there is no consensus among players as to the type of balance which imparts optimum playing characteristics to the racquet. Moreover, as a player develops from the level of a beginner through an intermediate to an advanced stage, his racquet preference may also undergo change.

For the purpose of aiding a player during warm-up exercises, it is sometimes the practice in such games as golf and baseball to attach a temporary weight to the club or bat in order to strengthen the muscles of the player. The use of weights for this purpose is also known in tennis. Thus in one prior art, a practice weight in the form of a weighted band is disclosed which is wrapped about the rim of the racquet frame.

The drawback of a weight of this prior art device, apart from the difficulties it presents in attaching the band to the frame or removing it therefrom, is that it inherently renders the racquet head-heavy. This is objectionable to a player who prefers a handle-heavy or a more balanced racquet.

SUMMARY OF INVENTION

In view of the foregoing, it is the main object of this invention to provide a weight and belt assembly which may be strapped on the handle shaft of a tennis racquet at any desired position to modify the balance of the racquet or to serve as a training aid.

More particularly, it is an object of this invention to provide an assembly of the type in which the belt incorporates a fabric fastener making it possible to strap the belt firmly about the shaft regardless of its girth.

A significant feature of an assembly in accordance with the invention is that once it is strapped on the shaft of the racquet, it will not slip or fly off regardless of how hard one hits the ball with the racquet. Another advantage of the invention is that the same belt may be used in conjunction with different weights.

Also an object of the invention is to provide a compact, low-cost weight and belt assembly that aids a tennis player in the court while hitting—helping the player to groove his strokes, to develop greater racquet control and to increase concentration.

Briefly stated, the assembly comprises a weighted plate having a pair of parallel slots therein and a flexible belt which is threaded through the slots to support the plate, a buckle loop being attached to one end of the belt and a tab to the other end thereof. Formed on the outer face of the tab is a uniform pile of stiff, hook-shaped fibers which constitute the male components of a fabric fastener, and formed along the same face of the belt are randomly dispersed fibers creating the fuzzy female component of the fastener.

To strap the assembly to the shaft at a desired position thereon, the plate is pressed against one side of the shaft and the tab is pulled through the buckle loop on the other side thereof and is folded over to cause the male component to engage the female component, thereby holding the assembly tightly on the shaft.

OUTLINE OF DRAWINGS

For a better understanding of the invention as well other objects and further features thereof, reference is made to the following detailed description to be read in conjunction with the accompanying drawings, wherein.

Figures 1, 2, 3, 4, 5:
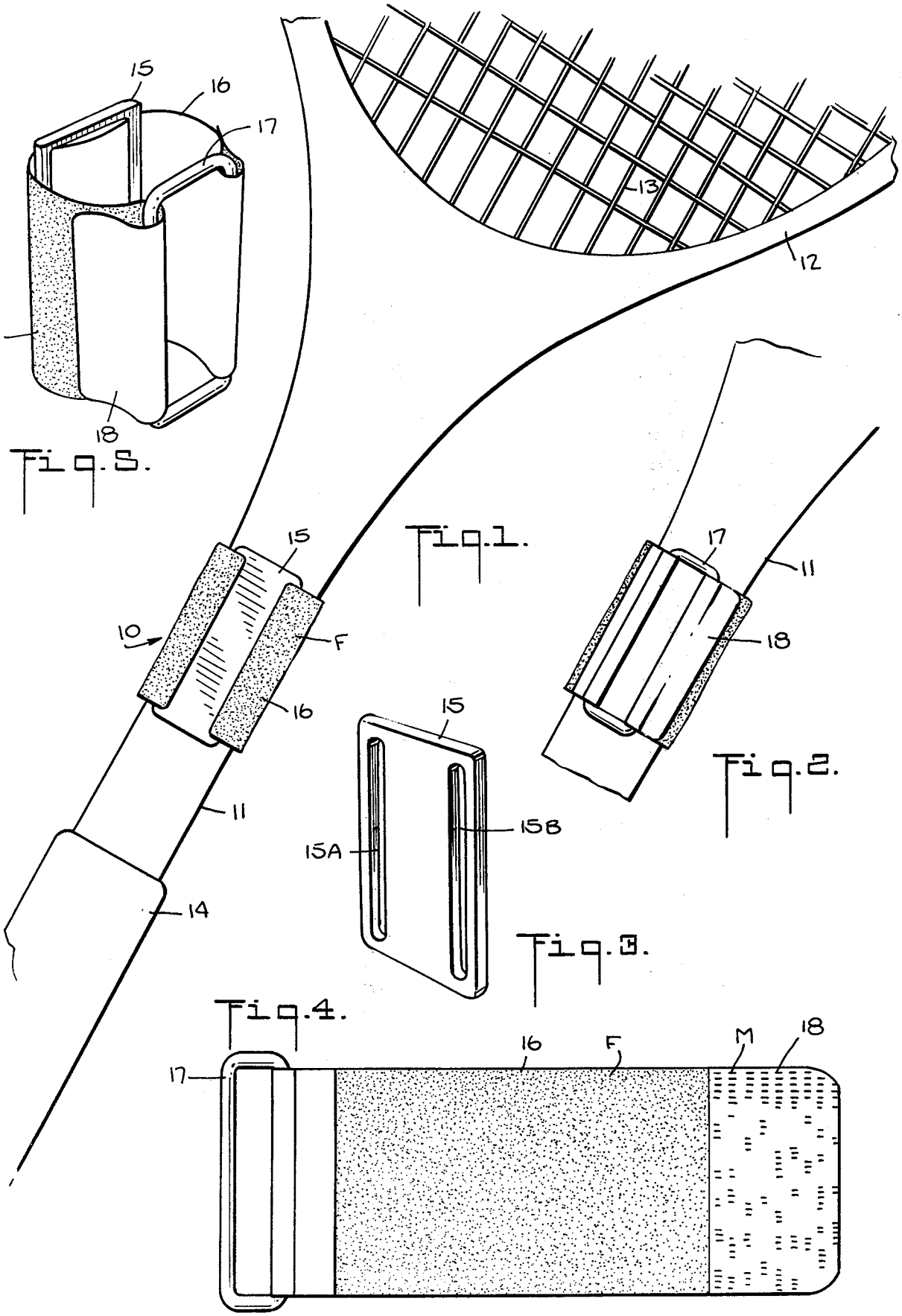
FIG. 1 is a perspective front view of a tennis racquet having a weight and belt assembly in accordance with the invention strapped to the shaft thereof.
FIG. 2 is a rear view of the assembly strapped to the shaft.
FIG. 3 is a separate perspective view of the weighted plate.

FIG. 4 separately shows the belt; and

FIG. 5 illustrates how the male component of the fabric fastener folds over to engage the female component.

DESCRIPTION OF INVENTION

Referring now to FIGS. 1 and 2, there is shown a weight and belt assembly in accordance with the invention, generally designated by numeral 10, which is attached to the handle shaft 11 on a tennis racquet having an oval frame 12, across which is stretched a netting 13 of nylon or other suitable fiber. The shaft terminates in a grip 14.

The assembly is constituted by a weight 15 in the form of a generally-rectangular plate fabricated of a lead-tin alloy or any other appropriate heavy metal, and a fabric belt 16 which may be of woven polyester material or any other durable, high-strength fabric which is preferably brightly colored. Plate 15 is provided with a pair of parallel slots 15A and 15B which run adjacent the opposing long sides of the plate, the length of the slots matching the width of the belt, whereby the belt may be threaded through the slot to support the weight at about the midpoint of the belt. One end of belt 16 is folded over one rung of a buckle 17 and bonded to the belt to retain the loop, whereas the other end of the belt has a tab 18 attached thereto. The loop is preferably molded of synthetic plastic material.

The outer face of tab 18 is provided with a uniform pile M of stiff, hook-shaped fibers which function as the male component of a fabric fastener of the so-called "Velcro" type. The corresponding face of belt 15 is covered with randomly-dispersed fibers creating a fuzzy surface, which surface functions as the female component F of the fastener.

The nature of this fabric fastener is such that when the male component is pressed down on the female component, the hook-shaped fibers penetrate and snag onto the fuzzy surface of the female component. When the male component is in engagement with the female component, these components cannot be laterally dislodged, and disengagement can only be effected by peeling the male component off the female component.

To attached assembly 10 onto racquet shaft 11, weight 15 is rested flat against the front face of the shaft at a position therealong that is selected on the basis of the effect to be attained. Thus should the player wish to impart a head-heavy characteristic to the racquet, the weight position is then made close to the frame; but where the player seeks to produce a hand-heavy characteristic, the weight position is then close to grip 14. Clearly, the choice of position depends on the normal characteristic of the racquet; for if the racquet is, say, hand-heavy to begin with, one can alter this characteristic by placing the weight toward the head to bring about a more balanced characteristic.

With the plate flat against the front face of the shaft at a selected position, one then slips tab 18 through buckle loop 17 at the rear face of the shaft and pulls the tab back tightly in the opposite direction, the tab then being brought down on the fuzzy surface of the belt to fasten the belt in place. Obviously, the extent to which the tab may be pulled through the loop and the turned over position it occupies along the fuzzy surface depends on the girth of the shaft. And since in the typical shaft, this girth varies as one goes from the grip to the frame, the length of the belt must be great enough to take these variations into account.

In practice, the preferred total weight for the entire assembly is 28 grams, the plate by itself being 21.6 grams. This total weight is roughly the difference between a light and a medium-weight racquet, so that the player can feel the difference immediately when he begins hitting on the court. The influence of this mass, which is concentrated at one position of the shaft, depends, of course, on its relative proximity to the head and hand. The assembly is not limited to a plate of a particular mass, for the same belt may be threaded through plates of different weight as long as the plates are formed with a pair of parallel slots. Thus the player may be provided with a set of plates.

Because the belt has a conspicuous color, the assembly is effective in helping to maintain concentration during practice or actual play; for the brightly-colored belt keeps the attention of the player focused on the plane of his swing and on the ball.

When using the assembly as a warm-up and practice weight, it is preferably attached mid-shaft for hitting forehand and backhand groundstrokes. To practice punching volleys, the assembly is placed as close to the head of the racquet as possible; and for improving serves and overheads, the assembly is positioned just above the grip, thereby strengthening the hands and wrist.

While the assembly is mainly intended as a precision warm-up weight, some players may find it to their advantage to begin actual play with the assembly attached; and at some point in the course of play removing the assembly, this being equivalent to switching to a lighter racquet during a match to restore a feeling of quickness to the handling of the racquet. This is more convenient than bringing extra racquets to the court.

While there has been shown and described a preferred embodiment of a weight and belt assembly in accordance with the invention, it will be appreciated that many changes and modifications may be made therein without, however, departing from the essential spirit thereof.

We claim:

1. In combination with a tennis racquet, a weight and belt assembly which is strappable at a selected position along the shaft of said tennis racquet to modify the balance thereof, said assembly comprising:

*A* a flexible belt having a buckle loop attached to one end and a tab attached to the other end thereof;

*B* a fabric fastener having a male component formed on substantially the entire outer surface of the tab and a female component formed on substantially the entire outer surface of the belt whereby the belt may be strapped about the shaft by slipping the tab through the loop and folding it over to bring about engagement between the male and female components at a point along the outer surface of the belt causing the belt to tightly hold the shaft without flapping of the tab regardless of the width of the shaft; and

*C* a weight attachable to said belt, said weight being constituted by a generally rectangular plate whose width is no greater than the width of said shaft at the selected position thereon, said plate having a pair of longitudinally extending parallel slots through which said belt is threaded to hold said plate against one side of said shaft while said loop is held against the other side thereof.

2. An assembly as set forth in claim 1, wherein said plate is fabricated of a lead alloy.

3. An assembly as set forth in claim 3, wherein said plate weighs about 20 grams.

4. An assembly as set forth in claim 1, wherein said male component is formed by a uniform array of stiff fabric hooks and said female component by randomly-dispersed fibers forming a fuzzy surface which are penetrable by said hooks.

5. An assembly as set forth in claim 1, wherein said belt is formed of a brightly-colored fabric which is sufficiently conspicuous to keep the attention of the player focused on the plane of his swing.

* * * * *